US005386344A

United States Patent [19]

Beaman et al.

[11] Patent Number: 5,386,344

[45] Date of Patent: Jan. 31, 1995

[54] FLEX CIRCUIT CARD ELASTOMERIC CABLE CONNECTOR ASSEMBLY

[75] Inventors: Brian S. Beaman, Hyde Park; Fuad E. Doany, Katonah; Thomas J. Dudek, Poughkeepsie; Alphonso P. Lanzetta, Marlboro; Da-Yuan Shih, Poughkeepsie; William J. Tkazyik, Hyde Park; George F. Walker, New York, all of N.Y.

[73] Assignee: International Business Machines Corporation, Armonk, N.Y.

[21] Appl. No.: 9,498

[22] Filed: Jan. 26, 1993

[51] Int. Cl.[6] ..... H01R 23/68; H01R 4/58

[52] U.S. Cl. ..... 361/785; 361/773; 361/776; 361/789; 174/261; 439/65; 439/66; 439/91; 439/591; 439/498

[58] Field of Search ..... 439/59, 60, 61, 62, 439/65, 66, 67, 91, 491, 492, 591, 498; 361/395, 396, 398, 400, 401, 402–406, 408, 412–415, 789; 174/250–251, 253–256, 258, 260, 261, 267, 268

[56] References Cited

U.S. PATENT DOCUMENTS

| | | | |
|---|---|---|---|
| 3,795,037 | 3/1974 | Luttmer | 174/35 GC |
| 3,954,317 | 5/1976 | Gilissen et al. | 439/59 |
| 4,116,516 | 9/1978 | Griffin et al. . | |
| 4,815,979 | 3/1989 | Porter . | |
| 4,948,379 | 8/1990 | Evans . | |
| 4,993,958 | 2/1991 | Trobough et al. . | |
| 4,998,885 | 3/1991 | Beaman | 439/66 |
| 5,049,084 | 9/1991 | Bakke | 439/66 |
| 5,059,129 | 10/1991 | Brodsky et al. . | |
| 5,092,782 | 3/1992 | Beaman | 439/65 |
| 5,123,851 | 6/1992 | Young et al. . | |

OTHER PUBLICATIONS

"High Density Flexible Connector", IBM Technical Disclosure Bulletin, vol. 32, No. 7, pp. 344–346, Dec. 1989.

*Primary Examiner*—Bot Ledynh
*Attorney, Agent, or Firm*—Lynn L. Augspurger

[57] ABSTRACT

A flex circuit card with an elastomeric cable connector assembly is provided for transmitting high speed signals between two or more printed circuit boards in a high performance computer system. The flex circuit card connects a cable assembly to a printed circuit board. A conductor trace in the flex circuit card extends into an elastomeric end and terminates with a ball shaped contact which is angled to wipe against mating pads on the printed circuit card for making electrical contact. The cable assembly uses multiple wires attached to a plurality of elastomeric connectors. At least one elastomeric connector is attached to each end of the cable assembly and each elastomeric connector has a plurality of contacts which are used to mate with a plurality of pads on the surface of the printed circuit board. The elastomeric connector described in the present invention provides a high density, cable-to-board interconnection that is perpendicular to the surface of the printed circuit board.

18 Claims, 3 Drawing Sheets

FLEX CIRCUIT CARD ELASTOMERIC CABLE CONNECTOR ASSEMBLY

FIELD OF THE INVENTION

The present invention is directed to flex circuit cards and particularly to an elastomeric cable connector assembly for transmitting high speed signals between two or more printed circuit boards in a high performance computer system.

GLOSSARY OF TERMS

Elastomer—A polymer with elastic, rubber-like properties.

ELASTIPAC—Refers to an elastomeric cable connector used for high speed signal applications which is an acronym which may be applied to the cable connector assembly of the present invention.

BACKGROUND Of THE INVENTION

In the computer industry, cable assemblies are used for many purposes including power distribution, low speed signal communication, and high speed signal communication. In a high performance computer system, specialized cable assemblies are used to transmit the high speed signals from processor to processor, processor to memory, and processor to I/O devices. These specialized high speed cable assemblies are mechanically and electrically connected to the printed circuit boards that support each of these key functions.

The time of flight or propagation delay for the high speed signals between these functions is critical to the overall performance of the computer system. The total propagation delay for these high speed signals is determined by the length of the circuit traces and wires used to transmit the signals from one point to another and the dielectric properties of the materials surrounding these circuit traces and wires. As computer systems increase in performance, the propagation delay for the high speed signals can be decreased by reducing the total path length for the signals to travel as well as improving the dielectric properties for the printed circuit boards and cable assemblies. An improvement in the propagation delay can be achieved by decreasing the board space required to connect to the high speed cable assemblies which in turn reduces the overall size of the board and the internal wiring along with the total space required for the system. The net result of the size reduction (or increase in packaging density) is a reduction in the signal propagation delay and an opportunity to increase the system performance.

The packaging density of a cable-to-board connector system is measured by the total number of signal and ground contacts divided by the total area used to attach and connect the cable assembly to the printed circuit board. This area is determined by the size of the cable mounting hardware and the distance or pitch between the rows and columns of contacts in the connector system. Decreasing the pitch between contacts is a common approach used to increase the packaging density of a cable connector system. As the pitch of the contacts is decreased, the size of the contacts is also decreased and smaller contacts are more prone to physical damage and quality defects.

Smaller spring contacts are more susceptible to stress relaxation of the spring material that can cause reliability problems in a connector system. Besides the material and quality limitations of using smaller contacts, there are many other limiting factors for increasing the packaging density of a cable connector including the physical size of the discrete high speed wires along with the wireability requirements of the printed circuit board. Another technique that is used for increased packaging density requires a connector system design that allows the individual cable assemblies to be stacked side by side and mounted perpendicular to the printed board surface.

Almost all cable assemblies use a separate connector mechanism to join the cable wires to a printed circuit board. The few exceptions use a flexible polyimide or mylar circuit instead of wire cables and the integral contacts are part of the wiring on the flex circuit. The separate connector mechanism can be mounted to the printed circuit board using a variety of fabrication and assembly techniques including using pins soldered into plated through holes, pins with compliant sections pressed into plated through holes, and surface mounted leads attached to pads on the surface of the printed circuit board. These techniques may require separate processing steps to attach the connectors to the printed circuit board. Separate connector components and processing steps will increase the cost of the total assembly.

These fabrication and assembly techniques are additional limiting factors for the packaging density of a cable connector system. Typical plated thru holes are drilled into the printed circuit board on a fixed rectangular $0.100 \times 0.100$ inch grid or an interstitial or staggered $0.050 \times 0.050$ inch grid. These packaging density limitations are determined by the diameter of the hole along with the width and spacing of the internal board wiring. Although surface mounted cable connectors eliminate the need for the plated thru holes in the printed circuit board, the packaging density is limited by the surface mounted lead configuration and the area required for the solder pads on the surface of the printed circuit board.

In order to provide a reliable electrical connection between the cable assembly and the printed circuit board, it is necessary to provide a sliding or wiping action between the contact surfaces in the cable connector. This wiping action allows the contacts to push aside debris and penetrate any oxides or films between the two contact surfaces. Typical two piece cable connectors use a pin (male) and spring loaded socket (female) contact geometry. As the pin is inserted into the socket, the mating contact surfaces wipe against each other. Another design consideration for a reliable electrical connection between a cable assembly and the printed circuit board is the number of independent contact interfaces for each signal or power connection. Two or more independent contact interfaces provide redundancy.

In addition, we would note that there are publications and patents of which we are aware which are listed below with a brief discussion of each of the publications and patents.

Prior art: Publications

Technical Disclosure Bulletin (TDB) from time to time. In this ad reference may be had to TDB, Vol. 32, No. 7, December 1989, p344–346 which illustrates a High Density Flexible Connector with a polyimide carrier and cold plated copper contact balls in pressure contact with a contact pad.

Prior Art: Patents

1. U.S. Pat. No. 4,116,516, issued Sep. 26, 1978 to Griffin et al., describes a cable assembly that is used to connect two or more printed circuit boards. This cable uses multiple flex circuits to connect multiple rows of contacts on each end of the cable assembly. The end of each flex circuit in the cable assembly is staggered to provide multiple rows of contacts on each end of the cable. Special processing of the mating printed circuit board is necessary to provide the step like configuration of contacts.

2. U.S. Pat. No. 4,815,979, issued Mar. 28, 1989 to William W. Porter, illustrates a right angle electrical connector with or without a wiping action for attaching a mother board to a daughter board. This connector provides an elastomeric member 28.

3. U.S. Pat. No. 4,948,379, issued Aug. 14, 1990 to Robert F. Evans, illustrates a separable surface-mating electrical connector and assembly for spatially configuring multiple connector assemblies on circuit bearing substrates. This patent has a spring end for a contact 64.

4. U.S. Pat. No. 4,993,958, issued Feb. 19, 1991 to Trobough et al., describes a cable assembly that is used to interconnect two printed circuit boards. The cable assembly uses a flex circuit and an elastomer pad to connect a single row of contacts on each end of the cable assembly. The surface pads or traces on the flex circuit are pressed against the surface pads on the printed circuit board in a coplanar arrangement. The surface area required to accommodate the coplanar interface is significantly greater than the actual contact area of the pads on the circuit board.

5. U.S. Pat. No. 5,059,129, issued Oct. 22, 1991 illustrates a connector assembly including bi-layered elastomeric member 70. In this patent there is shown a circuit board 13 as well as a flex board 64. Many of IBM's older TDBs are cited in this patent, so they have not been repeated above.

6. U.S. Pat. No. 5,092,782, issued Mar. 3, 1992 illustrates an earlier invention of Brian S. Beaman. It illustrates integral elastomeric card edge connectors having elastomeric contact tab supports for providing positive contact pressure and the necessary wipe action to ensure electrical contact at the end of the printed circuit card 100.

7. U.S. Pat. No. 5,123,851, issued Jun. 23, 1992 illustrates an integrated connector module with conductive elastomeric contacts. In this patent a circuit board is illustrated by the board 12. Also there is a a flexible board 24, an elastomeric strip 38 and conductors 36.

SUMMARY OF THE INVENTION

This elastomeric cable connector system described in the present invention can be considered an ELASTIPAC assembly, which is an acronym developed to convey the object of this invention which is to provide an improved high performance elastomeric package including a cable assembly for interconnecting printed circuit boards.

Another object of the present invention is to provide such a cable assembly that can be assembled and disassembled into a plurality of subassemblies.

A further object of the present invention is to provide such a structure which has a perpendicular contact interface geometry for high density packaging applications.

An additional object of the present invention is to provide such a structure that does not require a separate connector mechanism mounted on the mating printed circuit board surfaces.

Yet another object of the present invention is to provide such a structure that does not require special processing techniques for fabricating the mating printed circuit boards.

Yet a further object of the present invention is to provide such a structure that provides a wiping action of the cable contact surfaces against the contacts on the mating printed circuit board surfaces.

Yet an additional object of the present invention is to provide such a structure which has at least two independent contact interfaces for each signal and ground connection between the cable assembly and the surface contact on the printed circuit board.

BRIEF DESCRIPTION OF THE DRAWINGS

These and other objects, features and advantages of the present invention will become apparent upon further consideration of the following detailed description of the invention when read in conjunction with the drawing figures, in which.

DETAILED DESCRIPTION OF THE INVENTION

The Preferred Embodiment

Figure 1:
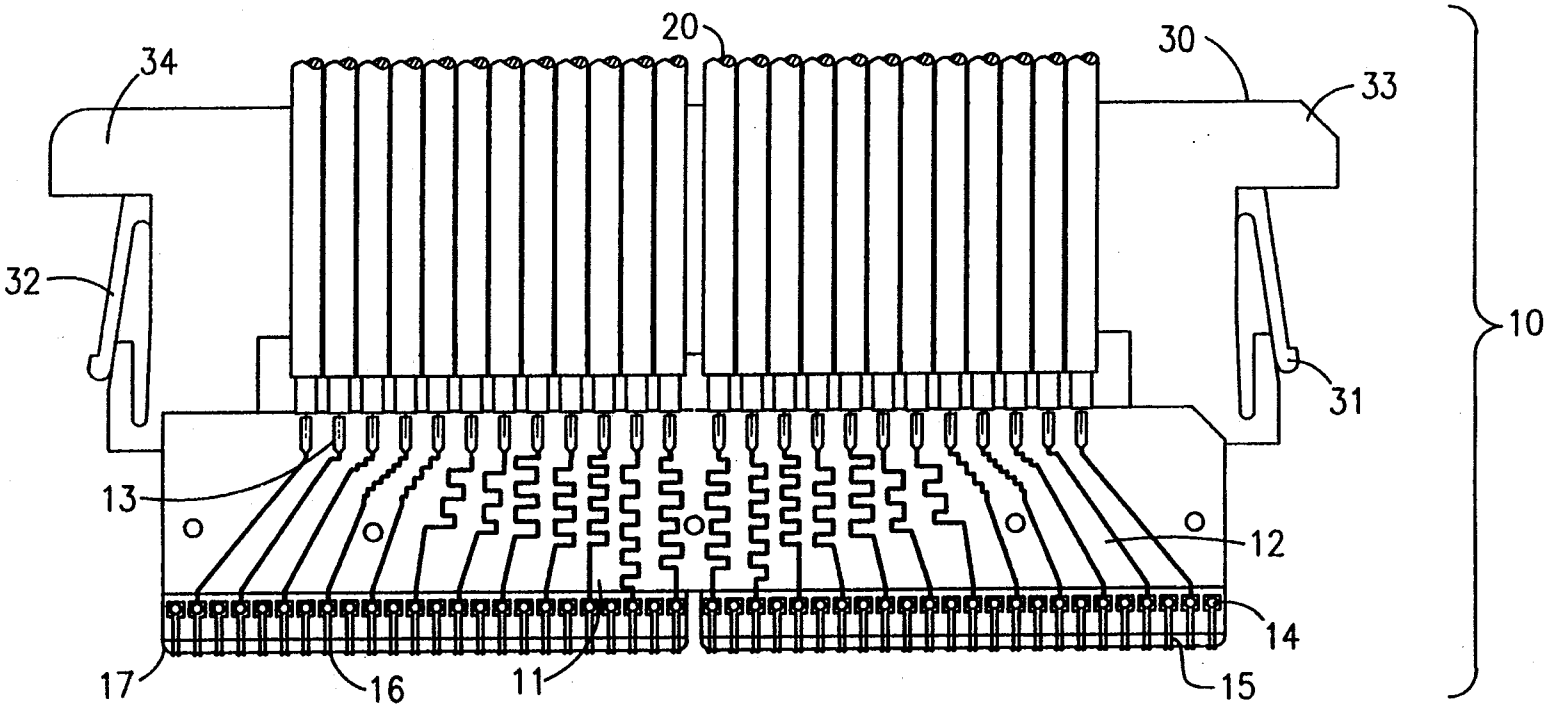
FIG. 1 shows a front view of a single subassembly of the high performance cable assembly according to the present invention.

FIG. 1 shows a front view of a single subassembly (10) of a high performance cable assembly according to the present invention. A single subassembly (10) is formed from several components including a plurality of discrete wires (20), a paddle card (11), and a housing (30). The paddle card (11) is formed from at least one layer of dielectric material such as epoxy glass or polyimide and has discrete circuit traces (12) on a first side and a ground plane on a second side. This type of circuit structure provides a controlled impedance interface that is essential for a high performance cable connector. The discrete circuit traces (12) on the first side have an enlarged pad (13) on the top edge of the paddle card (11). The discrete circuit traces (12) are also connected to a plated via hole (14) along the bottom edge of the paddle card (11). The ground plane on the second side of the paddle card is selectively connected to the via holes (14) along the bottom edge of the paddle card (11). Each via hole (14) has two circuit traces (15) extending to and continuing past the bottom edge of the paddle card (11). Each of these cantilevered circuit traces (15) has a ball shaped contact (16) formed on the ena that is plated with a diffusion barrier such as nickel and hard gold to provide a low resistance contact surface. The use of the two cantilevered circuit traces (15)

provides a redundant contact interface for each signal or ground contact on the printed circuit board to increase the reliability of the connector system. The bottom edge of the paddle card (11) along with the via holes (14), and the cantilevered circuit traces (15) are embedded in an elastomer material (17). The ball shaped ends (16) of the cantilevered circuit traces (15) are partially embedded in the elastomer material (17).

This ELASTIPAC elastomeric cable connector is used to connect a cable assembly to a printed circuit board. As will be appreciated, the ELASTIPAC will be used with a flex circuit with cantilever extensions of the signal traces along the bottom edge of the polyimide or mylar dielectric with ball shaped contacts formed on the ends of these circuit traces. Two cantilever traces formed at an angle are embedded in an elastomer so that individual high speed cables may be terminated to the solder plated pads on the flex circuit. Each cable assembly allows the plural or multiple cable assemblies which will be described to be mounted side-by-side in a plastic molded grouper housing. While cable grouper of the HARCON type are known, the current housing provides a stiffener for the cantilevered circuit traces which are formed at an angle to provide a compliant, wiping connection with mating pads on the mating printed circuit board.

Figure 2:
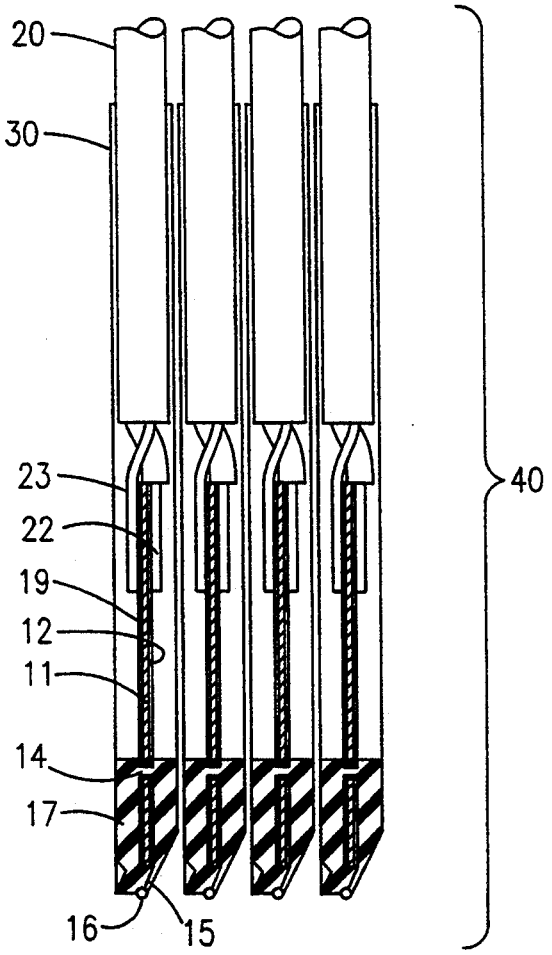
FIG. 2 shows an end view of four subassemblies stacked together to form a complete cable assembly.

FIG. 2 shows an end view of four subassemblies (10) stacked together to form a complete cable assembly (40). The FIGURE also shows a cross section of the four paddle cards (11) for each of the subassemblies (10) having discrete circuit traces (12) on a first side of the paddle card (11) and a ground plane (19) on the second side of the paddle card (11). Each discrete wire (20) in the cable assembly (40) has at least one signal conductor (22) and one ground or drain conductor (23). The signal conductor (22) for each of the discrete wires is attached to the enlarged pad on the end of the discrete circuit traces (12) along the top edge of the paddle card (11). The drain conductor (23) for each of the discrete wires (20) is attached to the ground plane (19) on the second surface of the paddle card (11). A plastic or metal housing (30 element 65 in FIG. 4) is attached to the paddle card (11) to act as a stiffener for the subassembly as well as to provide strain relief for the plurality of discrete wires (20) that are terminated to the paddle card (11). The housing (30) also has mechanical latching (31,32) and keying (33,34) features on the left and right sides (shown in FIG. 1) that allow the separate subassemblies (10) to be stacked together in the correct sequence.

Figure 3:
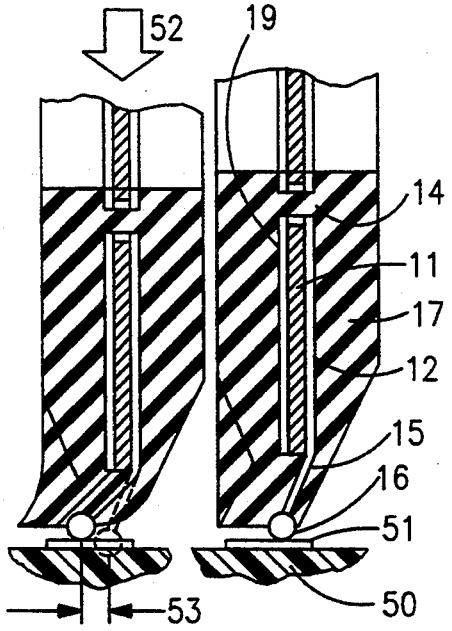
FIG. 3 shows a partial end view of two subassemblies and the contact pads of the mating printed circuit board.

FIG. 3 shows a partial end view of two subassemblies and the contact pads (51) of the mating printed circuit board (50). The subassembly on the left side of FIG. 3 shows the ball shaped contact (16) on the end of the cantilevered circuit trace (15) and the entire bottom edge of the paddle card (11) embedded in an elastomer material (17). The cantilevered circuit traces (15) of the subassembly on the left side of FIG. 3 are formed at an angle to the surface of the paddle card (11). The angled cantilevered circuit traces (15) and the angled cross section of the elastomer material allows the ball shaped contacts (16) to wipe against the contact pads (51) on the mating printed circuit board (50). The subassembly on the left side of FIG. 3 shows a subassembly being pressed against the contact pad (51) on the printed circuit board (50). The pressure and vertical motion (52) of the subassembly causes the ball shaped contact (16) to deflect and wipe (53) against the contact pad (51) on the printed circuit board (50).

The described cable connector assembly can be used for signal cable connections using either TRI-LEAD, TRIAX or twisted pair cable wires. In addition, it can be used, as we describe herein with ribbon or flat cable for signal power cable connections. Typical spacing between pairs of ball shaped contacts would be 0.050 inch on an individual cable assembly. This allows closer spacing of stacked assemblies than a spacing which could be used with a HARCON cable grouper which could allow cable assemblies on a 0.050 spacing.

In assembly, the cable connector assembly is aligned and pressed against mating contacts on the printed circuit board. Alignment of the ball shaped contacts to the plated contacts on the PCB can be achieved by a center located alignment slot in the flex circuit and cable housing. The slot would be mated with a locating rig attached to the printed circuit board. A housing similar to the HARCON cable group is used to mechanically retain the ELASTIPAC cables and provides the stiffener and contact force against the contacts on the PCB. As the ELASTIPAC cable connector is pressed against the printed circuit board, the ball shaped contacts wipe on the surface of the contacts to penetrate any films or contamination.

Fabrication can stad with a flex circuit that has signal traces on one side and a ground plane on the other side. The signal traces are formed to allow cantilevered extensions along the bottom edge of the flex circuit. Each signal trace is split into two (bifurcated) cantilevered extensions, and this allows redundancy. Each cantilevered trace, which is formed of copper, is melted with a Nd-YAG laser to form the ball contact. The ball forming process is performed in an inert atmosphere in order to avoid oxidation of the copper. The traces are plate with a nickel diffusion barrier and a hard gold surface. The top end of the signal traces are plated with solder to provide a termination pad for discrete cable wires.

During manufacture the flex circuit is placed in a mold cavity that is used to form an elastomeric connector assembly. The mold cavity positions the cantilever circuit traces and ball shaped contacts at an angle to the base of the flex circuit. Then liquid elastomer can be cast into the open mold or the assembly can use injection molding techniques to fill the cavity with elastomer to surround the cantilevered circuit traces. If injection molding is used, the ends are coated with strippable material, which can be stripped to remove it after molding to expose the ball shaped contact surfaces. The shape of the molded material is angled to provide the wiping contact action which has been illustrated in FIG. 3.

Final assembly can proceed thereafter. The jacket and insulation of discrete cables can be stripped, the signal wires soldered to the solder plated contacts on the flex circuit, and the ground wires soldered to the ground plane on the back side of the flex circuit. After the cable wires are terminated to the circuit card, a two piece housing is attached to the assembly to provide the alignment, keying and stiffening retainment to the housing.

Alternative Preferred Embodiments

Figure 4:
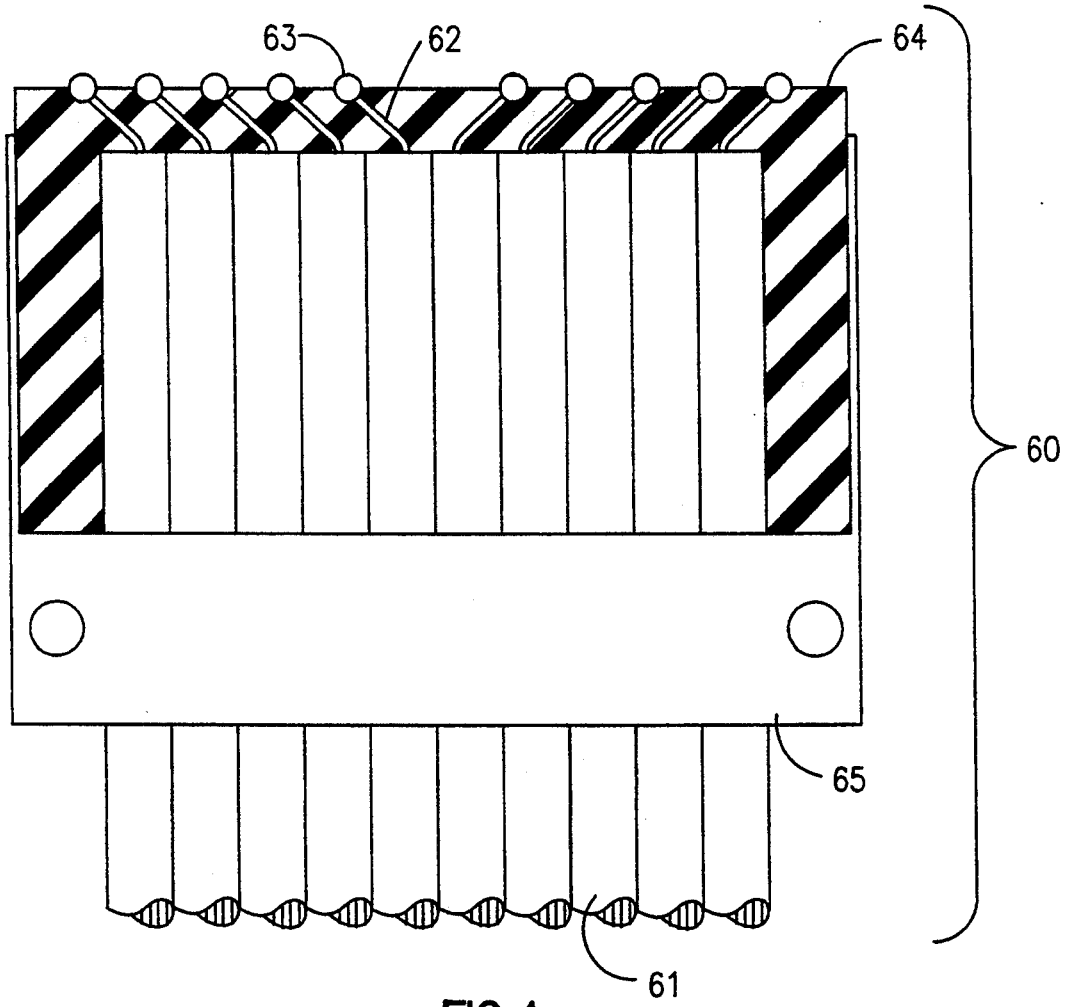
FIG. 4 shows the end and front views of an alternate embodiment of the present invention.

FIG. 4 shows the front view of an alternate embodiment (60) of the present invention. The alternate embodiment (60) shown in FIG. 4 uses a ribbon cable (61) with solid wire conductors (62) to form the ball shaped contacts (63) for the cable connector interface. The solid conductors (62) in the ribbon cable (61) are exposed to form the ball shaped contacts (63) and then plated with a diffusion barrier such as nickel and hard gold to provide a low resistance contact surface. The exposed solid wire conductors (62) are formed at an angle to allow the contacts to wipe against the contact pads on the mating printed circuit board. The end of the ribbon cable (61) along with the exposed solid wire conductors (62) are embedded in an elastomer material (64). The ball shaped contacts (63) on the ends of the solid wire conductors (62) are partially embedded in the elastomer material (64). Other types of cables with solid wire conductors can also be used in place of the ribbon cable (61) shown in FIG. 4.

Figure 5:
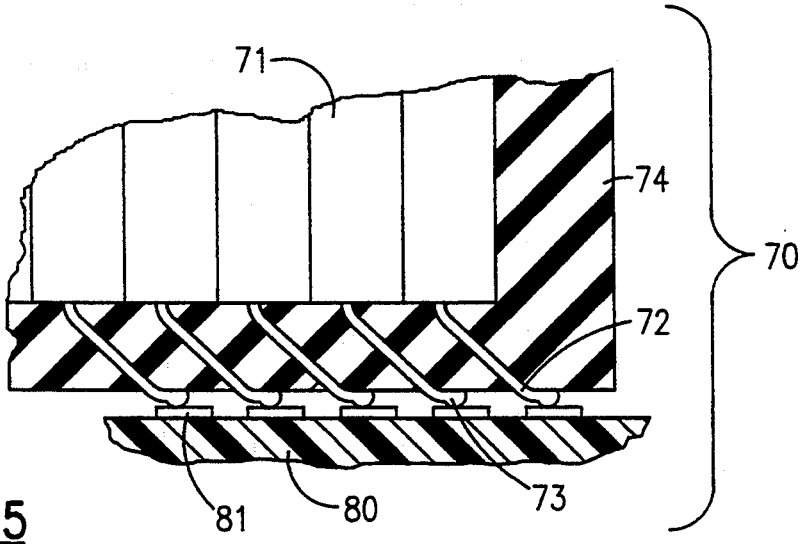
FIG. 5 shows partial end and front views of an alternate embodiment of the contact interface described in the present invention.

FIG. 5 shows a partial view of an alternate embodiment of the contact interface described in the present invention. The alternate embodiment (70) shown in FIG. 5 uses a similar ribbon cable (71) with solid wire conductors (72) that are exposed at the end of the cable assembly. A stamping process is used to form the raised contact shape (73) on the end of the exposed solid wire conductor (72). The end of the ribbon cable (71) along with the exposed solid wire conductors (72) are embedded in an elastomer material (74). The raised contact shape (73) on the ends of the solid wire conductors (72) are partially embedded in the elastomer material (74). The exposed solid wire conductors (72) are formed at an angle to allow the contacts to wipe against the contact pads (81) on the mating printed circuit board (80).

While we have described our preferred embodiments of our invention, it will be understood that those skilled in the art, both now and in the future, may make make various improvements and enhancements which fall within the scope of the claims which follow. These claims should be construed to maintain the proper protection for the invention first disclosed.

What is claimed is:

1. A high performance cable assembly comprising in combination:

a plurality of subassemblies stacked together to form a cable assembly;

each of said plurality of subassemblies comprising a housing and a paddle card attached to said housing;

each paddle card having discrete circuit traces connecting a plurality of discrete wires for transmitting high speed signals along a top edge of a first side of the paddle card to a plurality of contacts along a bottom edge of the first side of the paddle card adapted for contact to a mating printed circuit board;

each of said plurality of contacts along the bottom edge of the paddle card being formed of two cantilevered circuit traces with a ball shaped contact on an end of each cantilevered circuit trace embedded in an elastomer material to provide a compliant elastomeric interconnection and contact configuration for said subassemblies that will allow said cable assembly of stacked subassemblies of housings and paddle cards to be mounted perpendicular to the surface of said mating printed circuit board.

2. The cable assembly combination of claim 1, wherein the cable assembly further comprises in combination said mating printed circuit board, said mating printed circuit board having a plurality of pads on the surface thereof for mating with said plurality of contacts along the bottom edge of the paddle card to form a contact interface for said cable assembly that will allow said cable assembly of stacked subassemblies of housings and paddle cards to be mounted perpendicular to the surface of said mating printed circuit board without the use for a separate connector that is permanently mounted on said printed circuit board.

3. The cable assembly combination of claim 2, wherein the contact interface includes a cable with solid wire conductors that are exposed at the end of the cable assembly.

4. The cable assembly combination of claim 3, wherein the contact interface includes a raised contact shape on the end of one of said exposed solid wire conductors and the end of the cable along with the exposed solid wire conductors are embedded in said elastomer material and the raised contact shape on the ends of the solid wire conductors are partially embedded in said elastomer material.

5. The cable assembly combination of claim 4, wherein the exposed solid wire conductors are formed at an angle to allow contacts to wipe against contact pads on the mating printed circuit board.

6. The cable assembly combination of claim 1 wherein the paddle card is formed from at least one layer of dielectric material and has discrete circuit traces on a first side and a ground plane on a second side and provides a circuit structure as a controlled impedance interface for a high performance cable connector.

7. The cable assembly combination of claim 6, wherein the discrete circuit traces on the first side have an enlarged pad on the top edge of the first side of the paddle card.

8. The cable assembly combination of claim 7, wherein the discrete circuit traces are also connected to plated via holes along the bottom edge of the first side of the paddle card.

9. The cable assembly combination of claim 8, wherein each via hole has said two cantilevered circuit traces extending to continuing past the bottom edge of the first side of the paddle card.

10. The cable assembly combination of claim 9 wherein each of the ball shaped contacts is plated with a diffusion barrier to provide a low resistance contact surface to provide with the two cantilevered circuit traces a redundant contact interface for each signal or ground contact on the mating printed circuit board to increase the reliability of the cable assembly combination.

11. The cable assembly combination of claim 10, wherein the bottom edge of the first side of the paddle card along with the via holes, and the cantilevered circuit traces are embedded in said elastomer material and the ball shaped ends of the cantilevered circuit traces are partially embedded in the said elastomer material.

12. The cable assembly combination of claim 10 wherein said diffusion barrier is formed of nickel and hard gold.

13. The cable assembly combination of claim 7, wherein said ground plane on the second side of the paddle card is selectively connected to plated via holes along the bottom edge of the first side of the paddle card.

14. The cable assembly combination of claim 1, wherein said plurality of subassemblies stacked together to form a complete cable assembly combination with a like plurality of paddle cards for each of the subassemblies each having discrete circuit traces on a first side of the paddle card and a ground plane on the second side of the paddle card.

15. The cable assembly combination of claim 14, wherein each of said discrete wires in the cable assembly has at least one signal conductor and one drain conductor, and the signal conductor for each of the discrete wires is attached to an enlarged pad on the end of the discrete circuit traces along the top edge of the paddle card of one of said subassemblies.

16. The cable assembly combination of claim 15, wherein the drain conductor for each of the discrete wires is attached to the ground plane on the second side of the paddle card and a housing is provided for each paddle card to provide a stiffener for the subassembly as well as to provide strain relief for the plurality of discrete wires that are terminated to the paddle card.

17. The cable assembly combination of claim 16, wherein the housing has mechanical latching and keying on the left and right sides for stacking separate subassemblies together in a correct sequence.

18. The cable assembly combination of claim 16, wherein said cantilevered circuit traces for the subassembly are formed at an angle to the surface of the paddle card and the angled cantilevered circuit traces and an angled cross section of an elastomer material allows said ball shaped contact to wipe against a contact pad on the mating printed circuit board, whereby pressure and a vertical motion of the subassembly causes the ball shaped contact to deflect and wipe against the contact pad on the mating printed circuit board during assembly.

* * * * *